US010132449B2

(12) United States Patent
Wang et al.

(10) Patent No.: US 10,132,449 B2
(45) Date of Patent: Nov. 20, 2018

(54) LAMP DEVICE, LED LAMP AND LUMINAIRE

(71) Applicant: PHILIPS LIGHTING HOLDING B.V., Eindhoven (NL)

(72) Inventors: Bao Wang, Eindhoven (NL); Xiaoqing Duan, Eindhoven (NL); Yan Xiong, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/128,115

(22) PCT Filed: Mar. 16, 2015

(86) PCT No.: PCT/IB2015/051893
§ 371 (c)(1),
(2) Date: Sep. 22, 2016

(87) PCT Pub. No.: WO2015/145297
PCT Pub. Date: Oct. 1, 2015

(65) Prior Publication Data

US 2017/0227170 A1 Aug. 10, 2017

(30) Foreign Application Priority Data

Mar. 26, 2014 (CN) ..... 2014 2 0163520 U

(51) Int. Cl.
*F21K 9/238* (2016.01)
*F21V 23/06* (2006.01)
(Continued)

(52) U.S. Cl.
CPC ..... *F21K 9/238* (2016.08); *F21K 9/235* (2016.08); *F21V 23/005* (2013.01); *F21V 23/06* (2013.01); *F21Y 2115/10* (2016.08)

(58) Field of Classification Search
CPC ..... F21K 9/238; F21K 9/235; F21V 23/005; F21V 23/06; F21Y 2115/10
See application file for complete search history.

(56) References Cited

U.S. PATENT DOCUMENTS

2013/0257278 A1* 10/2013 DeVore ..... H01J 5/54 315/113
2015/0103537 A1* 4/2015 Moon ..... F21V 29/506 362/373

FOREIGN PATENT DOCUMENTS

CN 202927699 U 5/2013
CN 203082611 U 7/2013
(Continued)

*Primary Examiner* — Mary Ellen Bowman
(74) *Attorney, Agent, or Firm* — Akarsh P. Belagodu

(57) ABSTRACT

Various embodiments of the present application provide a lamp device, an LED lamp, and a luminaire. The lamp device according to the embodiments of the present utility mode comprises: a lamp cap having a central pin (21, 211) for providing an electrical connection to the lamp device; and a printed circuit board at least partially located within the lamp cap, wherein a lamp driver (12) is mounted on the printed circuit board; characterized in that a bottom edge of said printed circuit board includes a notch (16, 161) comprising a first contact electrically contacting said central pin. The lamp device according to the present application improves the assembly of the lamp device and enhances the production efficiency.

12 Claims, 2 Drawing Sheets

(51) Int. Cl.

| | |
|---|---|
| ***F21K 9/235*** | (2016.01) |
| ***F21V 23/00*** | (2015.01) |
| *F21Y 115/10* | (2016.01) |

(56) References Cited

FOREIGN PATENT DOCUMENTS

| | | | |
|---|---|---|---|
| DE | 202013000980 | U1 | 4/2013 |
| EP | 2053301 | A1 | 4/2009 |
| WO | WO2014056242 | A1 | 4/2014 |

* cited by examiner

LAMP DEVICE, LED LAMP AND LUMINAIRE

CROSS-REFERENCE TO PRIOR APPLICATIONS

This application is the U.S. National Phase application under 35 U.S.C. § 371 of International Application No. PCT/IB2015/051893, filed on Mar. 16, 2015, which claims the benefit of Chinese Patent Application No. 201420163520.X, filed on Mar. 26, 2014. These applications are hereby incorporated by reference herein.

FIELD OF THE INVENTION

Embodiments of the present disclosure relate to the field of illumination, and more specifically, relate to a lamp device, an LED lamp, and a luminaire.

BACKGROUND OF THE INVENTION

Figure 1:
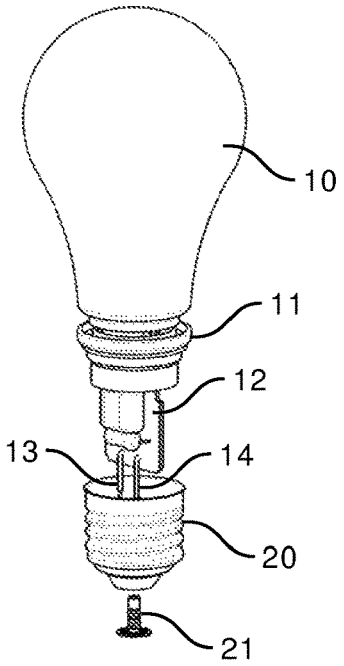
Figure 2:
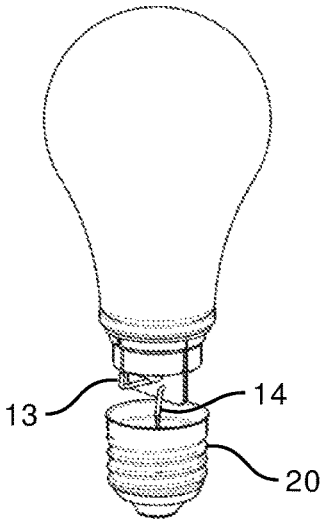
Figure 3:
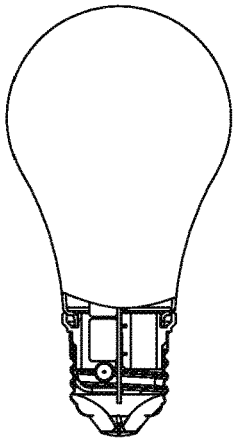

FIGS. 1-3 show a schematic diagram of electrical connection for a lamp device in the prior art. As shown in FIG. 1, the lamp device 10 comprises a lamp casing 11 and a lamp cap 20, wherein a light source (not shown) such as a light emitting diode LED (not shown) is configured to be electrically connected to a printed circuit board in the lamp device 10, which printed circuit board is at least partially located inside the lamp cap 20, and the printed circuit board is at least configured with a lamp driver 12 for driving the LED light source to emit light.

The lamp device as shown in FIG. 1 generally needs to connect two wires 13, 14 (i.e., a neutral wire (N) and a live wire (L)) coupled out from the lamp driver 12 to the lamp cap 20 of the lamp device, so as to receive a drive current. With reference to FIGS. 2 and 3, the live wire (L) 14 is electrically connected to a central pin 21 of the lamp cap 20, and the neutral wire (N) is electrically connected to a side section of the lamp cap 20.

However, the two electrical connections usually need to be completed by manual welding, which makes it hard to assemble the entire lamp device through an automatic process, thereby reducing the production efficiency.

US 2013/0257278 A1 discloses electrical connectors for a solid state lighting device including a poke-in connector on a driver circuit that mates with a pin connector in the base of the device for receiving power from a power source and a neutral clip that provides for an electrical ground connection between the driver circuit and the base. Although such connectors avoid the need for manual welding, they are additional components in the solid state lighting device, which makes the assembly of the device more involved and increases the overall cost of the device. CN 203082611 U discloses a LED bulb having a PCB driver assembly that includes a connector to the lamp cap. This connection has been found unsatisfactory as it is not secure enough.

SUMMARY OF THE INVENTION

In view of the above, an objective of the present disclosure at least lies in providing an improved lamp device and/or luminaire, which at least can overcome one or more deficiencies existing in the prior art, thereby improving assembly of the lamp device and boosting the productivity.

According to a first aspect of the present disclosure, there is provided a lamp device, comprising: a lamp cap having a central pin for providing an electrical connection to the lamp device; and a printed circuit board at least partially located within the lamp cap, wherein a lamp driver is mounted on the printed circuit board; characterized in that a bottom edge of said printed circuit board includes a notch comprising a first contact electrically contacting said central pin. Such a notch integral to the printed circuit board obviates the need for contact welding as well as for additional connection components mounted on the printed circuit board, thereby facilitating a lamp device that can be manufactured in a straightforward and cost-effective manner.

According to a further embodiment of the present disclosure, the first contact is formed by part of the notch or by the whole notch.

The first contact may be a metal contact such as a copper contact.

The metal contact may be formed on a bottom part or on a side part of the notch.

According to a further embodiment of the present disclosure, the notch is formed as a resilient element for receiving the central pin. This ensures a particularly secure connection between the central pin and the driver circuit.

According to a further embodiment of the present disclosure, a side edge of said printed circuit board comprises a second contact, in electrical contact with a side wall of the lamp cap.

In an embodiment, the second contact is formed by metal deposited in a predetermined position on said side edge or on a protrusion of the side edge.

According to a further embodiment of the present disclosure, the protrusion forms part of a pattern of protrusions on said side edge that at least partially matches a thread of the lamp cap. This ensures a particularly secure fit of the printed circuit board in the lamp cap.

According to a further embodiment of the present disclosure, the notch is formed as a resilient element for receiving the central pin. This ensures a particularly secure connection between the central pin and the driver circuit.

According to a further embodiment of the present disclosure, the second contact is formed as a resilient element.

According to a further embodiment of the present disclosure, the resilient element is a leaf spring.

According to a further embodiment of the present disclosure, the lamp cap has a further central pin for providing an electrical connection to the lamp device; and the bottom edge of said printed circuit board includes a further notch comprising a second contact electrically contacting said further central pin.

According to a second aspect of the present disclosure, there is provided an LED lamp, comprising a lamp device according to any embodiment of the first aspect.

According to a third aspect of the present disclosure, there is provided a luminaire comprising a LED lamp according to the second aspect.

BRIEF DESCRIPTION OF THE ACCOMPANYING DRAWINGS

Figure 4:
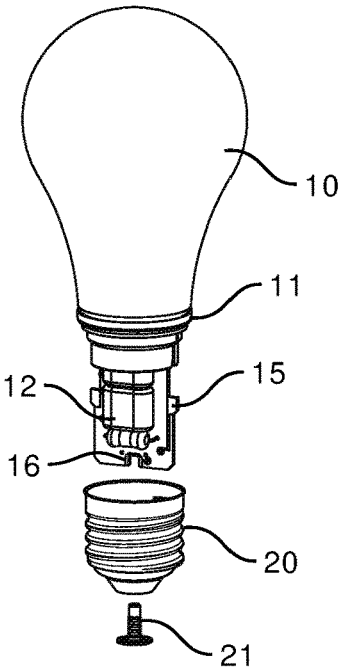
Figure 5:
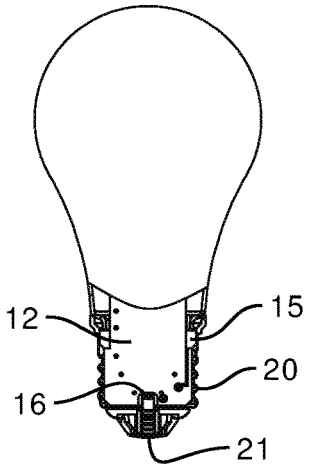
Figure 6:
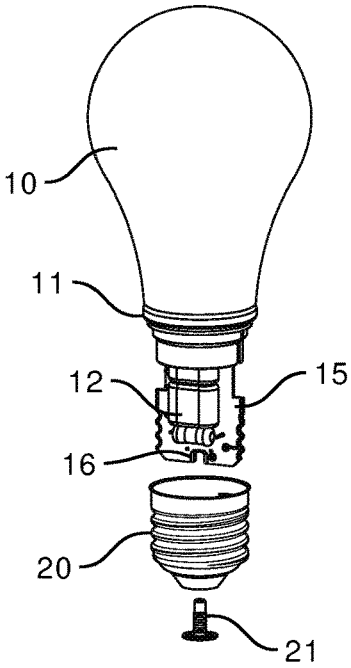
Figure 7:
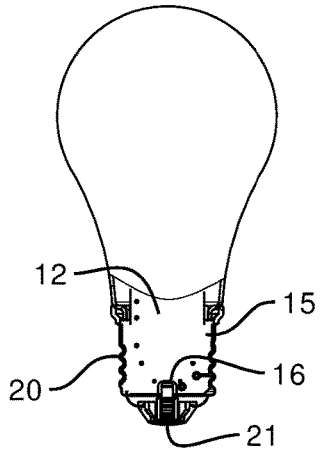
Figure 8:
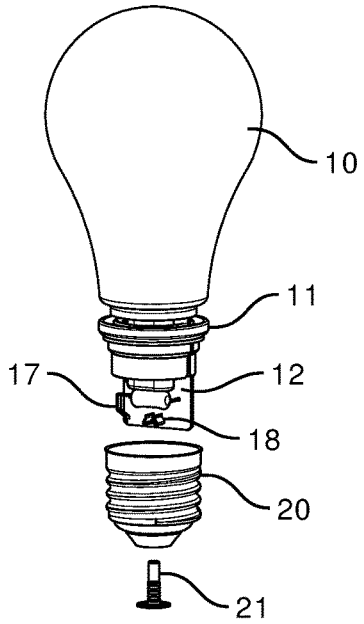
Figure 9:
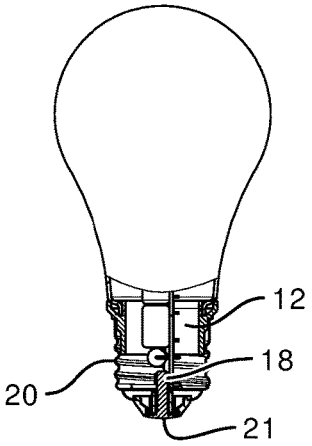
Figure 10:
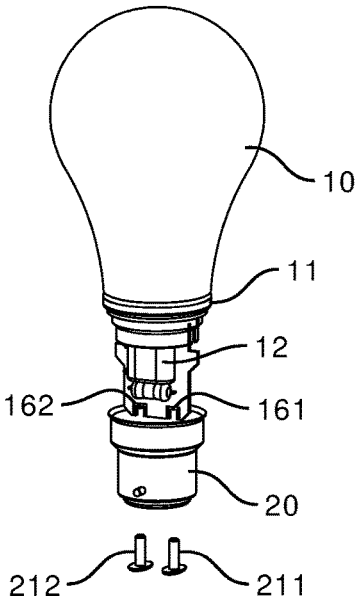
Figure 11:
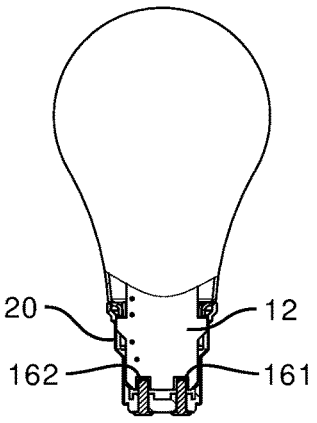

In the drawings, like/same reference numerals throughout different views generally refer to like/same parts. The drawings are not necessarily to scale, emphasis instead generally being placed upon illustrating the principles of the present disclosure. In the accompanying drawings, FIG. 1 schematically shows an exploded view of a structure of a lamp device according to the prior art;

FIG. 2 schematically shows a connection view of electrical connection wires of a lamp device according to the prior art;

FIG. 3 schematically shows a side view of an assembled lamp device in the prior art;

FIG. 4 schematically shows an exploded view of a lamp device according to a first embodiment of the present disclosure;

FIG. 5 schematically shows a side view of an assembled lamp device according to a first embodiment of the present disclosure;

FIG. 6 schematically shows an exploded view of a lamp device according to a second embodiment of the present disclosure;

FIG. 7 schematically shows a side view of an assembled lamp device according to a second embodiment of the present disclosure;

FIG. 8 schematically shows an exploded view of a lamp device according to a third embodiment of the present disclosure;

FIG. 9 schematically shows a side view of an assembled lamp device according to a third embodiment of the present disclosure;

FIG. 10 schematically shows an exploded view of a lamp device according to a fourth embodiment of the present disclosure; and FIG. 11 schematically shows a side view of an assembled lamp device according to a fourth embodiment of the present disclosure.

DETAILED DESCRIPTION OF THE PREFERRED EMBODIMENTS

Hereinafter, various embodiments of the present disclosure will be described in detail with reference to the accompanying drawings. One or more examples of the embodiments are illustrated by the accompanying drawings. The embodiments are provided through illustration of the present disclosure, not intended to limit the present disclosure. For example, features as illustrated or described as a part of one embodiment may be used in another embodiment so as to generate a further embodiment. The present disclosure intends to cover these and other modifications and variations of the scope and spirit of the present disclosure.

FIG. 4 schematically shows an exploded view of a lamp device 10 according to a first embodiment of the present disclosure. The lamp device 10 comprises a lamp casing 11 and a lamp cap 20, wherein a light source (not shown) such as a light emitting diode is configured to be electrically connected to a printed circuit board within the lamp device 10, which printed circuit board is at least partially located within the lamp cap 20, which printed circuit board is at least provided with a lamp driver 12 configured to drive the light source to emit light.

According to a first embodiment of the present disclosure, alternative to the configuration of the wires 13, 14 as shown in FIG. 1 of the prior art, the lamp device 10 in FIG. 4 comprises a notch 16 on a bottom edge of the printed circuit board, to form a first contact in electrical connection to a central pin 21 of the lamp cap 20; and a second contact 15 located at a predetermined position (or height) on a side edge of the printed circuit board, so as to be electrically connected to a side wall of the lamp cap.

According to a first embodiment of the present disclosure, the notch 16 may be integrally formed with the printed circuit board. Preferably, the first contact may be integrally formed by the notch 16. More preferably, the first contact may be a part of the notch 16. Preferably, the second contact 15 may be located at a predetermined position (or height) of a substantially vertical side edge of the printed circuit board, or on a protrusion of a predetermined position (or height) of the substantially vertical side edge.

According to the embodiments of the present disclosure, the first contact 16 and the second contact 15 are preferably metal contacts, e.g., copper contacts. Preferably, metal may be deposited at a predetermined position (e.g., a bottom or a side part) of the notch to form a first contact, and metal may be deposited at a predetermined position (or height) of the side edge of the printed circuit board or on a protrusion of a predetermined position (or height) of the side edge.

Through the above configuration, the notch 16 forms an L (a live wire) pole of the lamp driver 12 to receive the central pin 21 of the lamp cap 20; the second contact 15 forms an N (a neutral wire) pole of the lamp driver 12 to be electrically connected to a side wall of the lamp cap 20.

FIG. 5 schematically shows a side view of an assembled lamp device according to a first embodiment of the present disclosure. It is seen from the side view of FIG. 5 that in the assembled lamp device, the central pin 21 of the lamp cap 20 is inserted into the notch 16 (L pole), while the second contact 15 (N pole) of the side edge of the printed circuit board abuts against the side wall of the lamp cap 20, thereby realizing electrical connections of the L pole and N pole of the lamp driver 12 to the lamp cap, respectively.

Apparently, over the structure of the lamp device of the prior art in FIG. 1, an advantage of the first embodiment of the present disclosure lies in that it does not require the wires 13, 14 and its further welding of the wires. Because in the first embodiment of the present disclosure, by electrically connecting the notch 16 and the second contact 15 to the lamp cap, respectively, the notch 16 and the second contact 15 may be integrally formed as part of a printed circuit board arranged with a lamp driver, which therefore simplifies and facilitates assembly of the circuit printed board and the lamp cap.

FIG. 6 schematically shows an exploded view of a lamp device according to the second embodiment of the present disclosure. Similar to the structure of FIG. 4 of the first embodiment of the present disclosure, the lamp device 10 of the second embodiment of the present disclosure comprises a lamp casing 11 and a lamp cap 20, wherein a light source (not shown) such as a light emitting diode LED is configured to be electrically connected on a printed circuit board within the lamp device 10; the printed circuit board is at least partially located within the lamp cap 20, and the printed circuit board is at least configured with a lamp driver 12 for driving the light source to emit light.

The lamp device 10 according to the second embodiment of the present disclosure differs from the lamp device of the first embodiment only in that a side edge of the circuit printed board forms a pattern of protrusions, i.e. a thread, at least partially matching a thread of the lamp cap 20, while the second contact 15 is formed on (at least some of) the protrusions of the side edge of the printed circuit board, i.e. on the thread.

Preferably, when the second contact 15 is formed on a thread of the side wall of the printed circuit board, the second contact 15 may be located on the thread at a predetermined position (or height) of the side edge, e.g. by depositing a metal in the predetermined location, for example; when the second contact 15 is formed on a protrusion of the side edge of the printed circuit board, the second contact 15 may be located on a protrusion of a predetermined position (or height) by depositing a metal in the predetermined location, for example.

According to a further embodiment of the present disclosure, only when the thread, i.e. the pattern of protrusions, on the side edge of the printed circuit board is rotated with respect to the thread on the lamp cap 20 to a predetermined position, the second contact 15 is electrically connected to the side wall of the lamp cap.

FIG. 7 schematically shows a side view of an assembled lamp device according to the second embodiment of the present disclosure. In this embodiment, like the lamp device according to the first embodiment, the central pin 21 of the lamp cap 20 is inserted into the notch 16 (L pole), but the second contact 15 (N pole) located on a thread, i.e. on the pattern of protrusions, of a side edge of the printed circuit board, which abuts against the side wall of the lamp cap 20 by threaded connection to the thread of the lamp cap.

It should be appreciated that through this connection manner of the second embodiment, the electrical connection between the second contact and the lamp cap may be implemented even more securely and tightly.

FIG. 8 schematically shows an exploded view of a lamp device according to the third embodiment of the present disclosure. Similar to the structure of FIG. 4 of the first embodiment of the present disclosure, the lamp device 10 of the third embodiment of the present disclosure comprises a lamp casing 11 and a lamp cap 20, wherein a light source (not shown) in the light emitting diode LED is configured to be electrically connected on the printed circuit board within the lamp device 10; the printed circuit board is at least partially located within the lamp cap 20, and the printed circuit board is at least provided with a lamp driver 12 for driving the light source to emit light.

However, different from the first embodiment, the lamp device 10 in the third embodiment comprises an elastic element 18, i.e. a resilient element 18, on or near the bottom edge of the printed circuit board to form a first contact electrically connected to the central pin 21 of the lamp cap 20, and a further elastic element 17, i.e. a further resilient element 17, on or near the side edge of the printed circuit board, to form a second contact electrically connected to the lamp cap 20.

Preferably, the above resilient element is made of metal. More preferably, the resilient element is a metal leaf spring.

Additionally, preferably, the resilient element may be integrally formed or separately formed with the printed circuit board, e.g. as (part of) the notch 16.

FIG. 9 schematically shows a side view of an assembled lamp device according to the third embodiment of the present disclosure. It is seen from the side view of FIG. 9, in the assembled lamp device, the central pin 21 of the lamp cap 20 is inserted into the resilient element 18 (L pole), while a further resilient element (N pole) located at a side edge of the printed circuit board elastically abuts against the side wall of the lamp cap 20, thereby realizing electrical connection of the L pole and N pole of the lamp driver 12 to the lamp cap. Those skilled in the art should understand that the structure and location of the resilient element on the printed circuit board may be configured in any appropriate manner matching the central pin 21 and the side wall of the lamp cap 20.

Likewise, the embodiment does not need the welding of the L pole and the N pole wires in the prior art, thereby the assembly of the lamp cap may be facilitated in a simplified manner.

Through the description of the first to the third embodiments with reference to FIGS. 4-9, those skilled in the art should clearly appreciate the electrical connection provided by the first contact and the second contact of the present disclosure. This electrical connection manner of the present disclosure may realize a simple and reliable electrical connection between the first contact and the second contact and the lamp cap 20 in an automated process without the need for manual welding, thereby boosting the production efficiency and saving costs.

It should be noted that although the scenarios of E-caps (Edison cap, or screw fittings) have been described with reference to FIGS. 4-9, those skilled in the art would appreciate that the concept of the present disclosure is not limited to the E-cap scenario, but likewise applicable to other type of lamp caps, e.g., B-caps, except that in the case of application to other types of lamp caps, the positions of the first contact and the second contact need to be adjusted adaptively, as will be immediately apparent to the skilled person.

As a further example, implementation of such electrical connection will be described with respect to the scenario of a B-cap as the fourth embodiment.

FIG. 10 schematically shows an exploded view of the lamp device according to the fourth embodiment of the present disclosure. Similar to the structure of the previous embodiment, the lamp device 10 according to the fourth embodiment of the present disclosure comprises a lamp casing 11 and a lamp cap 20, wherein the light source (not shown) such as a light emitting diode LED is configured to be electrically connected to the printed circuit board within the lamp device 10; the printed circuit board is at least partially located within the lamp cap 20, and the printed circuit board is at least configured with a lamp driver 12 for driving the light source to emit light.

However, as shown in FIG. 10, the lamp cap 20 in this embodiment is a B-cap. The B-cap comprises two central pins 211 and 212, i.e. two pins symmetrically positioned relative to the central axis of the lamp cap 20. As an adaptive adjustment of the present concept in this embodiment, the printed circuit board correspondingly has notches 161 and 162 matching the two center pints 211 and 212, respectively.

The first notch 161 forms a first contact (e.g., L pole), and a second notch forms a second contact (e.g., N pole). Preferably, the first contact 16 and the second contact 15 are metal contacts, e.g., copper contacts. Preferably, metal is deposited at a predetermined location (e.g., of bottom or side) of the first and second notches to form the first contact and the second contact.

FIG. 11 schematically shows a side view of an assembled lamp device according to the fourth embodiment of the present disclosure. It is seen from the side view of FIG. 11, in the assembled head device, the first center pin 211 of the lamp cap 20 is inserted into the first notch 161, while the second center pin 212 of the lamp cap 20 is inserted into the second notch 162, thereby realizing electrical connection of the L pole and N pole of the lamp driver 12 to the lamp cap.

Preferably, the first notch and the second notch are integrally formed with the printed circuit board.

Likewise, the first and second notches may be modified in any appropriate manner, e.g., the first and second notches may be replaced by using the elastic elements.

The lamp device of the present disclosure has been described sufficiently and completely. Further, those skilled in the art would appreciate that the aforementioned lamp device may be applicable to a corresponding LED lamp and LED luminaire comprising such a LED lamp.

Although the present disclosure has been illustrated and described in detail in the accompanying drawings and the above description, the illustration and description should be regarded as illustrative or exemplary, rather than limitative; the present disclosure is not limited to the disclosed embodiments. Through studying the accompanying drawings, the disclosure, and the appended claims, those skilled in the art would appreciate and practice other modifications of the embodiments as disclosed when implementing the claimed invention.

In the claims, the word "comprise" does not exclude other elements; and the indefinite article "a" or "an" does not exclude plurality. A single element or other unit may satisfy the functions of a plurality of items recited in the claims. The mere fact that certain features are recited in mutually different embodiments or dependent claims does not mean that a combination of these features cannot be used to advantage. Without departing from the scope of the present disclosure, the protection scope of the present disclosure cover any possible combination of respective features recited in various embodiments or dependent claims.

No reference numerals in the claims should be understood as limitations to the scope of the present disclosure.

The invention claimed is:

1. A lamp device, comprising:

a lamp cap having a central pin for providing an electrical connection to the lamp device; and a printed circuit board at least partially located within the lamp cap, wherein a lamp driver is mounted on the printed circuit board, wherein a bottom edge of said printed circuit board includes a notch configured to receive the central pin, wherein the notch comprises a first contact electrically contacting said central pin;

wherein a vertical side edge of said printed circuit board comprises a second contact capable of electrically contacting a side wall of the lamp cap, wherein the vertical side edge comprises a pattern of protrusions that at least partially matches a thread of the lamp cap, and wherein the second contact of the vertical side edge is electrically connected to the side wall of the lamp cap only if the pattern of protrusions of the vertical side edge is rotated relative to the thread of the lamp cap to a predetermined position.

2. The lamp device of claim 1, wherein the first contact is formed by part of the notch or by the whole notch.

3. The lamp device of claim 1, wherein the first contact is a metal contact such as a copper contact.

4. The lamp device of claim 3, wherein the metal contact is formed on a bottom portion or on a side part of the notch.

5. The lamp device of claim 1, wherein the notch is formed as a resilient element for receiving the central pin.

6. The lamp device of claim 1, wherein the second contact is formed by metal deposited in a predetermined position on said side edge or on the protrusion of the side edge.

7. The lamp device of claim 5, characterized in that a side edge of said printed circuit board comprises a second contact, in electrically contact with a side wall of the lamp cap, is provided at a side edge of said printed circuit board, wherein the second contact is formed as a resilient element.

8. The lamp device of claim 5, wherein the resilient element is a leaf spring.

9. The lamp device according to claim 1, characterized in that:

the lamp cap has a further central pin for providing an electrical connection to the lamp device; and the bottom edge of said printed circuit board includes a further notch comprising a second contact electrically contacting said further central pin.

10. The lamp device of claim 5, wherein the first contact forms a live pole of the driver and the second contact forms a neutral pole of the driver.

11. A LED lamp comprising the lamp device according to claim 1.

12. A luminaire comprising the LED lamp according to claim 11.

* * * * *